United States Patent [19]

Leander

[11] 4,005,412

[45] Jan. 25, 1977

[54] APPARATUS FOR TRANSFERRING INFORMATION BETWEEN ELECTRONIC DISPLAY DEVICES AND MEANS FOR TRANSMITTING AND RECEIVING INFORMATION AND FOR SUPPLYING OPERATING CURRENT TO THE ELECTRONIC DISPLAY DEVICES

[75] Inventor: Bo Ingvar Leander, Tygelsjo, Sweden

[73] Assignee: Aktiebolaget Ljungmans Verkstader, Malmo, Sweden

[22] Filed: Mar. 7, 1975

[21] Appl. No.: 556,507

[30] Foreign Application Priority Data

Mar. 8, 1974 Sweden ..... 7403110

[52] U.S. Cl. ..... 340/380; 320/2; 340/336

[51] Int. Cl.[2] ..... G09F 9/32

[58] Field of Search ..... 340/380, 336, 324 R, 340/147 R; 320/2

[56] References Cited

UNITED STATES PATENTS

| | | | |
|---|---|---|---|
| 3,139,753 | 7/1964 | Brudner | 340/324 R |
| 3,353,026 | 11/1967 | Israely | 340/380 |
| 3,580,421 | 5/1971 | Bickford | 340/336 |
| 3,641,336 | 2/1972 | Boin | 320/2 |
| 3,840,795 | 10/1974 | Roszyk et al. | 320/2 |

*Primary Examiner*—Marshall M. Curtis

*Attorney, Agent, or Firm*—Beveridge, DeGrandi, Kline & Lunsford

[57] ABSTRACT

Apparatus for transferring information between an electronic display device and means for transmitting and receiving information and for supplying operating current to the electronic display device. The operating current is provided by a battery and the apparatus includes an operating circuit having an energizing means which charges the battery when the apparatus is not in use. The energizing means includes first inductive means located inside the fuel dispensing nozzle and second inductive means for coupling electromagnetically with the first inductive means located outside the nozzle. Conductors are arranged between the display device and the information transmitting and receiving means to provide safe transfer of information between them.

5 Claims, 3 Drawing Figures

APPARATUS FOR TRANSFERRING INFORMATION BETWEEN ELECTRONIC DISPLAY DEVICES AND MEANS FOR TRANSMITTING AND RECEIVING INFORMATION AND FOR SUPPLYING OPERATING CURRENT TO THE ELECTRONIC DISPLAY DEVICES

The invention relates to an apparatus for transferring information between an electronic display device and means for transmitting and receiving information and for supplying operating current to the electronic display device.

It was suggested some years ago to install a numeral wheel indicator for instance in delivery nozzles for dispensing e.g. petrol in service stations or like facilities. It proved, however, that such an arrangement met with serious difficulties, particularly with regard to the great risk of explosion. The problems encountered gave rise to complicated and expensive constructions. To eliminate the risk of explosion and to satisfy the requirements placed by the authorities on such constructions for safety reasons, above all low signal levels have been utilized hitherto, which makes the construction extremely sensitive to interference and therefore unreliable.

The main object of the present invention therefore is to wholly or at least partly eliminate the problems associated with the prior art constructions of this type.

According to the invention, the display device of the apparatus outlined in the foregoing is of intrinsically safe construction and includes an operating circuit having a first inductive coupling member for cooperating with a second inductive coupling member, operating current being supplied by means of said members to the operating circuit, and conductors are arranged between the display device and said information transmitting and receiving means to ensure intrinsically safe transfer of information between them.

The invention will be more fully described hereinafter and with reference to the accompanying drawings in which.

The apparatus according to the invention will now be described with regard to the supply and the transfer of information to a digital display device disposed on a delivery nozzle for dispensing e.g. petrol in a service station.

As is well known in this field, a customer often wishes to read, directly on the delivery nozzle, the dispensed number of liters of petrol and/or the cost of said dispensed number of liters of petrol.

Figure 1:
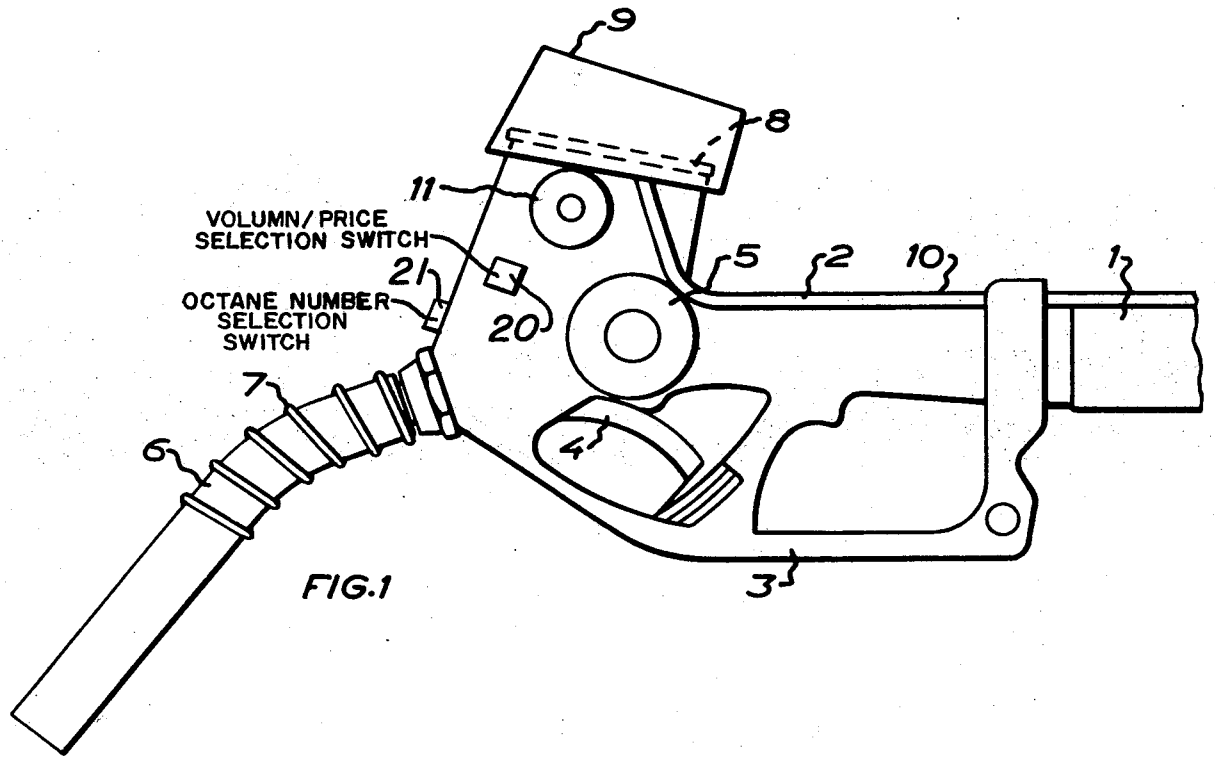
FIG. 1 is a diagrammatic side view of a delivery nozzle according to the invention.
Figure 2:
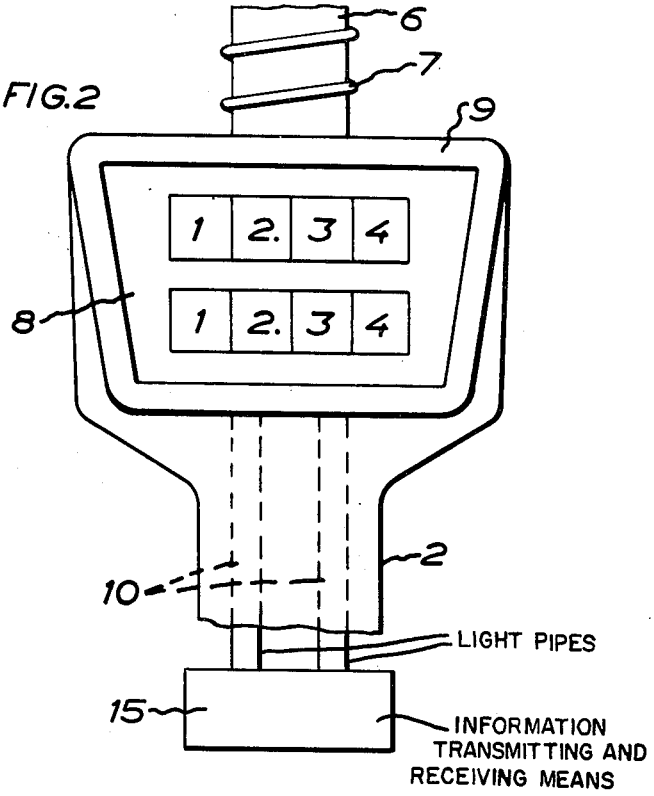
FIG. 2 is a fragmentary view of the delivery nozzle in FIG. 1, particularly illustrating a display device placed on said nozzle.

The delivery nozzle illustrated in FIG. 1 is connected to a hose 1 which leads to a petrol pump (not shown). The delivery nozzle comprises a handle 2 with a guard 3 for a finger grip and a trigger 4. The handle 2 contains a per se known valve mechanism for opening and closing the nozzle. This valve mechanism is operable by means of a diaphragm which is disposed inside the cover 5 of a diaphragm housing. The handle 2 further comprises a spout 6 which in a known manner has a latch spring 7. Moreover, the handle 2 carries a digital display device 8 having a protective collar 9. The digital display device 8 is illustrated more in detail in FIG. 2 and is adapted, in that instance, to show the dispensed number of liters and the cost of the dispensed number of liters in units of money. The digital display device is composed of per se known light-emitting diodes. The digital display device may also be arranged to show the dispensed quantity of petrol in liters or in units of money. The display device 8 may further be provided for instance with push buttons 21 and 20 respectively for selecting octane number and selecting display of number of liters or units of money.

Moreover, the delivery nozzle can be provided with a transistor-controlled relay for operating the diaphragm inside the cover 5 of the diaphragm housing, thereby to permit bringing about automatic opening and closure of the dispensing operation in the delivery nozzle proper.

The display device 8 is supplied with the information required for the display by the intermediary of two light guides 10 one of which is intended for the transmission of clock pulses while the other is intended for the transmission of information pulses.

The lead-in to the display device 8 of course is of an intrinsically safe design. The light guides 10 extend along the handle 2 and the hose 1 to a suitable means 15 located in the service station and delivering the requisite information. The light guides 10 can also serve to deliver information for the control of the transistor-controlled relay and also to transmit information from the push buttons for selecting octane number and selecting display of liters or units of money. To be as safe as possible the display device 8 must naturally be entirely encased, and there must not be transferred to said device any energy that may give rise to sparking at the transfer itself.

To this end, the apparatus according to the invention is equipped with a transformer coupling, one member 11 of which is disposed on the delivery nozzle in the vicinity of the display device 8. The member 11 is adapted to cooperate with a corresponding member 12 at the place where the delivery nozzle is hooked up when not in use. The member 12 is connected to a conventional mains. The members 11 and 12 are shown more fully in FIG. 3.

Figure 3:
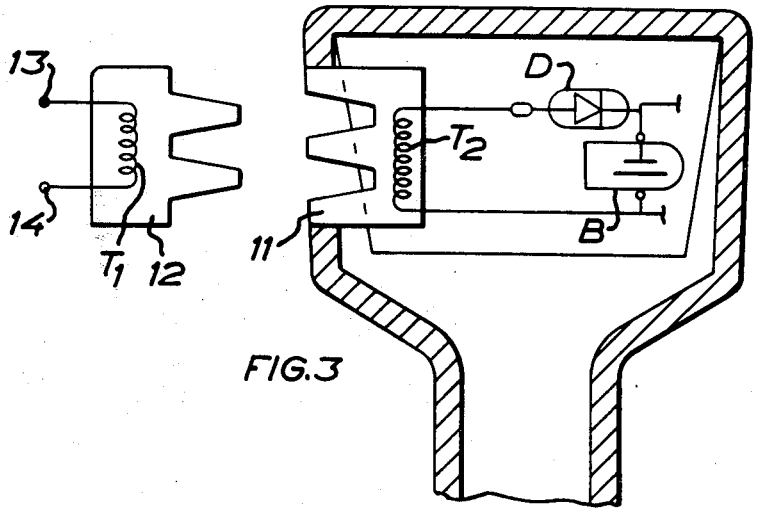
FIG. 3 is a wiring diagram for part of the display device.

The member 12 carries a winding T1 which via terminals 13 and 14 is connected to the conventional mains which may be considered as included in said means 15. The members 11 and 12 are soft-iron members and, after being brought together, from the core of a transformer, the primary winding of which is T1 while the secondary winding thereof is T2, said secondary winding T2 being arranged on the member 11. As illustrated in FIG. 3, the member 11 is located close to the digital display device 8. The winding T2 is connected into a circuit for charging a battery B. A diode D is also connected into said circuit. The remaining part of the display device 8 is connected to the battery B, said remaining part being of any conventional construction whatever. The apparatus according to the invention will charge the battery B as soon as the delivery nozzle has been hooked up. Thus, there need not take place any open transfer of current to the display device or to any other means connected to the operating circuit illustrated in FIG. 3. This arrangement will provide an extremely safe circuit.

As far as the information transfer is concerned, it should be observed that the light guides intended for the transfer of information from the stationary installation to the delivery nozzle are provided at their ends in the stationary installation with light-emitting diodes and at their delivery nozzle ends with photocells in a conventional manner. The light guides which are intended for the transfer of information from the delivery nozzle to the stationary installation are provided at their delivery nozzle ends with light-emitting diodes and at their other ends with photocells.

The above embodiment of the invention was described for purposes of illustration rather than limitation. All possible variations and modifications of the invention are understood as being included within the spirit and scope of the appended claims.

What we claim and desire to secure by Letters Patent is:

1. A system for displaying information transferred between a fuel dispensing nozzle and a remotely located information receiving and transmitting data source comprising a nozzle operative for the dispensing of fuel.

a data source located at a site remote from said nozzle, an information display device on said nozzle for displaying information data pertaining to fuel being dispensed, a battery energized operating circuit located inside said nozzle for supplying operating current to said display device.

energizing means operative only when said nozzle is inoperative for transferring electrical energy to said operating circuit, said energizing means including a first inductive means connected to said operating circuit and located inside said nozzle and a second inductive means for coupling electromagnetically with said first inductive means located outside said nozzle, and information conductor means connecting said display device with said data source for conducting information between said display device and said data source.

2. Apparatus as claimed in claim 1, wherein said inductive means each carry one winding and together constitute a transformer, said first inductive means being designed to fit in said second inductive means.

3. Apparatus as claimed in claim 1, wherein said conductors are light guides.

4. The system of claim 1 wherein said data source includes means for transmitting data to said nozzle and means for receiving data generated at said nozzle.

5. The system of claim 4 further including manually operated selection means located on said nozzle for generating data to be transmitted to said data source.

* * * * *